US010023408B2

(12) United States Patent
Kawashima

(10) Patent No.: US 10,023,408 B2
(45) Date of Patent: Jul. 17, 2018

(54) CONVEYING ROLLER UNIT, AND SHEET FEED DEVICE AND IMAGE FORMING APPARATUS EACH COMPRISING SAME

(71) Applicant: KYOCERA Document Solutions Inc., Osaka (JP)

(72) Inventor: Tetsuro Kawashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/540,156

(22) PCT Filed: Feb. 9, 2016

(86) PCT No.: PCT/JP2016/053851

§ 371 (c)(1),
(2) Date: Jun. 27, 2017

(87) PCT Pub. No.: WO2016/143452

PCT Pub. Date: Sep. 15, 2016

(65) Prior Publication Data

US 2017/0368851 A1 Dec. 28, 2017

(30) Foreign Application Priority Data

Mar. 9, 2015 (JP) ..... 2015-045628

(51) Int. Cl.
*B65H 3/06* (2006.01)

(52) U.S. Cl.
CPC ... *B65H 3/0638* (2013.01); *B65H 2404/1342* (2013.01); *B65H 2601/324* (2013.01); *B65H 2801/06* (2013.01)

(58) Field of Classification Search
CPC ..... B65H 3/0638; B65H 2404/1342; B65H 2601/324
See application file for complete search history.

(56) References Cited

U.S. PATENT DOCUMENTS 7,913,996 B2 * 3/2011 Nishikata ..... B65H 3/0638 271/145
8,196,918 B2 * 6/2012 Arimura ..... B65H 3/06 271/121

(Continued)

FOREIGN PATENT DOCUMENTS

JP 2005-206312 A 8/2005

*Primary Examiner* — Jeremy R Severson
(74) *Attorney, Agent, or Firm* — Stein IP, LLC

(57) ABSTRACT

A conveying roller unit comprises a first unit, a second unit, and a lock mechanism. The first unit comprises: a roller section; and a hollow cylindrical holder section. The second unit can be removably mounted to the first unit, and comprises: a second connection section; a rod section inserted into the holder section. The lock mechanism includes: a first engagement section provided on the inner circumferential surface of the holder section; a second engagement section provided on the outer circumferential surface of the rod section; and a urging member for pressing the second unit in the direction in which the rod section comes out of the holder section. The urging member maintains the first engagement section and the second engagement section in an engaged state and restricts the position of the second unit relative to the first unit in both the circumferential direction and the rotation axis direction.

13 Claims, 8 Drawing Sheets

(56) References Cited

U.S. PATENT DOCUMENTS

| | | | | |
|---|---|---|---|---|
| 8,500,115 | B2 * | 8/2013 | Yamomoto | B65H 3/0607 271/121 |
| 8,783,676 | B2 * | 7/2014 | Yamamoto | B65H 5/06 271/10.11 |
| 9,079,716 | B2 * | 7/2015 | Kawashima | B65H 3/06 |
| 2017/0153590 | A1 * | 6/2017 | Yamasaki | B65H 3/0607 |

* cited by examiner

CONVEYING ROLLER UNIT, AND SHEET FEED DEVICE AND IMAGE FORMING APPARATUS EACH COMPRISING SAME

CROSS-REFERENCE TO RELATED APPLICATIONS

This application is a national stage of International Application No. PCT/JP2016/053851 filed Feb. 9, 2016, which claims the benefit of Japanese Application No. 2015-045628, filed Mar. 9, 2015, in the Japanese Property Office, the disclosures of which are incorporated herein in their entireties by reference.

TECHNICAL FIELD

The present invention relates to a conveying roller unit for transporting a sheet, and a sheet feed device and an image forming apparatus each including the conveying roller unit.

BACKGROUND ART

Conventionally, a sheet feed device for feeding sheets, which is mounted in an image forming apparatus, is known. The sheet feed device includes a sheet tray and a conveying roller. The circumferential surface of the conveying roller contacts with the sheet placed on the sheet tray. Further, when the conveying roller rotates, the sheet is transported in a predetermined transport direction. Patent Document 1 discloses a technique in which the conveying roller can be removably mounted to a housing of the paper feeding device.

PRIOR ART DOCUMENTS

Patent Documents

Patent Document 1: JP-A-2005-206312

DISCLOSURE OF THE INVENTION

Problem to be Solved by the Invention

In the paper feeding device described in Patent Document 1, the conveying roller is removably mounted to a tip end part of the drive shaft axially supported by the housing. Inside the conveying roller, a coil spring and an adapter are mounted. A claw-like locking protruding part provided to the adapter is locked in a guide part hole of the conveying roller while compressing the coil spring, so that the adapter is fixed to the conveying roller, and the conveying roller is supported by the housing.

However, in the technique described above, the conveying roller is rotated in a state where the pressing force of the coil spring is continuously applied to the elastically deformed locking protruding part. As a result, there is a malfunction that the locking protruding part is plastically deformed so that the conveying roller is broken.

In view of the problem described above, it is an object of the present invention to provide a conveying roller unit that can be removably mounted to the housing and can prevent breakage of the conveying roller, and a sheet feed device and an image forming apparatus each including the conveying roller unit.

Means for Solving the Problem

In order to achieve the object described above, a first structure of the present invention is a conveying roller unit including a first unit, a second unit, and a lock mechanism. The first unit includes a cylindrical roller section capable of abutting a sheet, and a hollow cylindrical holder section having an outer circumferential surface on which the roller section is mounted, a first connection section disposed on one end side in a rotation axis direction, and an opening on the other end side. The second unit includes a second connection section disposed on the other end side in the rotation axis direction, and a rod section to be inserted to the inside of the holder section along an insertion direction from the other end side to the one end side in the rotation axis direction, so as to be capable of being removably mounted to the first unit. The lock mechanism locks the second unit to the first unit in an integrally rotatable manner. The lock mechanism includes a first engagement section provided to protrude from an inner circumferential surface of the holder section of the first unit, a second engagement section provided to protrude from the outer circumferential surface of the rod section of the second unit, and an urging member disposed inside the holder section so as to press the second unit in the direction that the rod section moves out of the holder section. An urging force of the urging member maintains engagement between the first engagement section and the second engagement section, and positions of the second unit in the circumferential direction and in the rotation axis direction with respect to the first unit are restricted so that the second unit is locked to the first unit.

Effects of the Invention

According to the first structure of the present invention, when the rod section of the second unit is positioned at a third position via a first position and a second position inside the holder section of the first unit, the second unit is locked to the first unit. As a result, the first unit and the second unit are prevented from being detached from each other by mistake, and the conveying roller unit can stably rotate. In addition, because the second unit is locked to the first unit by the engagement between the first protruding part and the second protruding part, plastic deformation of a lock member can be prevented compared with the case where the two units are locked to each other by the lock member that is elastically deformed like snap-fit. As a result, breakage of the conveying roller unit is prevented.

DESCRIPTION OF EMBODIMENTS

Figure 1:
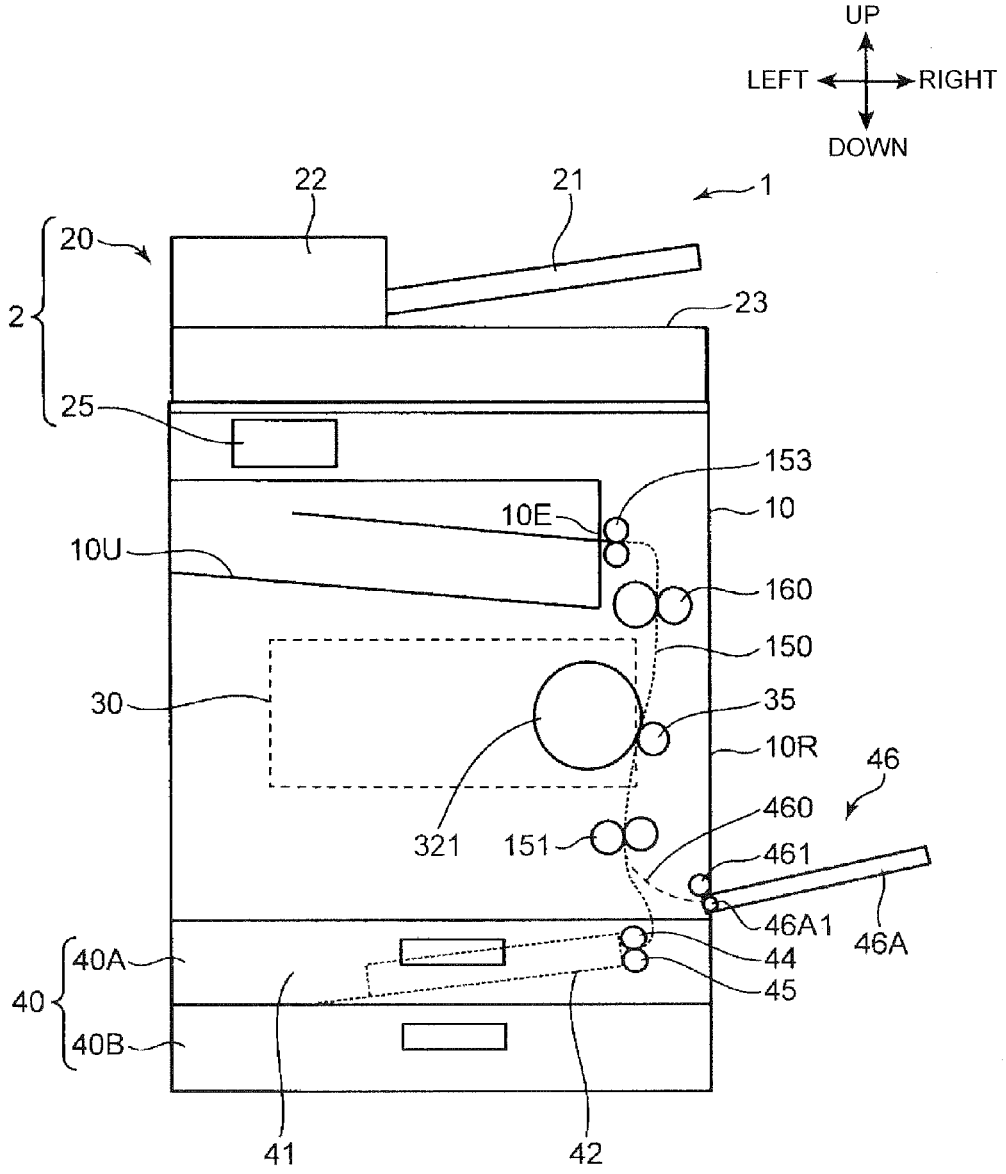
FIG. 1 is a cross-sectional view schematically illustrating an internal structure of an image forming apparatus equipped with a manual paper feeder to which a conveying roller unit of the present invention is mounted.

Hereinafter, with reference to the drawings, an embodiment of the present invention is described in detail. FIG. 1 is a schematic cross-sectional view illustrating an internal structure of an image forming apparatus 1 equipped with a manual paper feeder 46 as one embodiment of the sheet feed device of the present invention. Here, as the image forming apparatus 1, there is exemplified a multifunction peripheral having a printer function and a copier function, but the image forming apparatus may be a printer, a copier, a facsimile apparatus, or the like.

<Description of Image Forming Apparatus>

The image forming apparatus 1 includes an apparatus main body 10 having a housing structure of a substantially rectangular solid shape, and an automatic document feeder (hereinafter referred to as an ADF) 20 disposed on the apparatus main body 10. Inside the apparatus main body 10, there are a reading unit (reader) 25 that optically reads a document image to be copied, an image forming unit 30 that forms a toner image on a sheet, a fixing unit 160 that fixes the toner image to the sheet, a paper feed unit 40 that stores fixed-size sheets to be transported to the image forming unit 30, and a transport path 150 for transporting the fixed-size sheet from the paper feed unit 40 or the manual paper feeder 46 to a sheet discharge outlet 10E via the image forming unit 30 and the fixing unit 160.

The ADF 20 is pivotably mounted on the upper surface of the apparatus main body 10. The ADF 20 automatically feeds document sheets to be copied to a predetermined document reading position in the apparatus main body 10. On the other hand, when a user manually places a document sheet at a predetermined document reading position, the ADF 20 is opened upward. The ADF 20 includes a document tray 21 on which the document sheets are placed, a document transport unit 22 that transports the document sheets through the document reading position, and a document discharge tray 23 on which the document sheets after reading are discharged.

On the upper surface of the apparatus main body 10, there is disposed a contact glass for reading the document sheet fed automatically from the ADF 20, and a contact glass for reading the manually placed document sheet (not shown). The reading unit 25 optically reads an image of the document sheet via the contact glass. Note that the automatic document feeder (ADF) 20 and the reading unit 25 described above constitute an image reading device 2.

The image forming unit 30 generates a toner image based on a known electrophotographic method so as to form the toner image on the sheet. Note that another image forming method such an inkjet method may be adopted in another embodiment. The image forming unit 30 includes a photosensitive drum 321, and a charging unit, an exposing unit, a developing device, a cleaning device, and the like, which are disposed around the photosensitive drum 321 but are not shown.

The photosensitive drum 321 rotates about its axis so that an electrostatic latent image and a toner image are formed on the circumferential surface thereof. The charging unit charges the surface of the photosensitive drum 321 uniformly. The exposing unit includes a laser light source and optical system elements such as a mirror and a lens, and irradiates the circumferential surface of the photosensitive drum 321 with light based on the image data of the document image, so as to form the electrostatic latent image. The developing device supplies toner to the outer circumferential surface of the photosensitive drum 321 so as to develop the electrostatic latent image formed on the photosensitive drum 321. The cleaning device includes a cleaning roller or the like so as to clean toner remaining on the outer circumferential surface of the photosensitive drum 321 after the toner image is transferred. A transfer roller 35 is disposed to face the photosensitive drum 321. At a transfer nip portion between the photosensitive drum 321 and the transfer roller 35, the toner image on the photosensitive drum 321 is transferred to the sheet. The transfer roller 35 is applied with a secondary transfer bias having a polarity opposite to that of the toner.

The paper feed unit 40 includes two cassettes, i.e., a first paper feed cassette 40A and a second paper feed cassette 40B, which store fixed-size sheets among sheets on which the image forming process is performed. These paper feed cassettes 40A and 40B can be drawn out frontward from the front of the apparatus main body 10.

The first paper feed cassette 40A includes a sheet storing portion 41 for storing a bunch of sheets, which is a stack of fixed-size sheets, and a lift plate 42 that lifts up the bunch of sheets for feeding the sheets. On the upper part of the right end side of the paper feed cassette 40A, there are disposed a pickup roller that is not shown and a roller pair of a paper feed roller 44 and a retard roller 45. When the pickup roller and the paper feed roller 44 are driven, the sheets in the paper feed cassette 40A are fed one by one from the top sheet and are transported to the upstream end of the transport path 150. Note that the second paper feed cassette 40B has the same structure as the first paper feed cassette 40A.

The manual paper feeder 46 (sheet feed device) is disposed on a right side surface 10R of the apparatus main body 10. The manual paper feeder 46 transports the sheet to the image forming unit 30. The manual paper feeder 46 includes a manual feed tray 46A for manual paper feeding and a paper feed roller 461 (conveying roller unit). Sheets are placed on the manual feed tray 46A. The manual feed tray 46A is mounted in a manner of being capable of opening and closing about a pivot point 46A1 positioned at a lower end part thereof with respect to the apparatus main body 10. When performing the manual paper feeding, the user opens the manual feed tray 46A as illustrated in the diagram and places the sheets thereon. When the paper feed roller 461 is driven, the sheet placed on the manual feed tray 46A is transported to a manual sheet transport path 460 (sheet transport path) extending from the manual feed tray 46A for transporting the sheet in a predetermined sheet transport direction. The sheet transported in the sheet transport direction is transported from the manual sheet transport path 460 to the transport path 150. The paper feed roller 461 is driven to rotate in a predetermined rotation direction so as to transport the sheet in the sheet transport direction. The paper feed roller 461 is disposed to face the sheet transport direction downstream side of the manual feed tray 46A.

The transport path 150 extends from the paper feed unit 40 to the sheet discharge outlet 10E via the image forming unit 30 and the fixing unit 160. A registration roller pair 151 is disposed on the upstream side of the transfer nip portion in the transport path 150. The sheet is temporarily stopped by the registration roller pair 151 in a standstill state, and a skew thereof is corrected. After that, the registration roller pair 151 is driven to rotate by a drive unit (not shown) at a predetermined timing for image transfer, and hence the sheet is transported to the transfer nip portion.

A paper discharge roller 153 is disposed at the most downstream end of the transport path 150. The paper discharge roller 153 discharges the sheet from the sheet discharge outlet 10E. The sheets discharged from the sheet discharge outlet 10E are discharged and piled on a paper discharge part 10U.

The fixing unit 160 performs a fixing process for fixing the toner image to the sheet. A pressure roller is pressed to contact with the fixing roller that is not shown, so that a fixing nip portion is formed. When the sheet passes through the fixing nip portion, the transferred toner image on the sheet is fixed to the sheet.

<Manual Paper Feeder>

Figure 2:
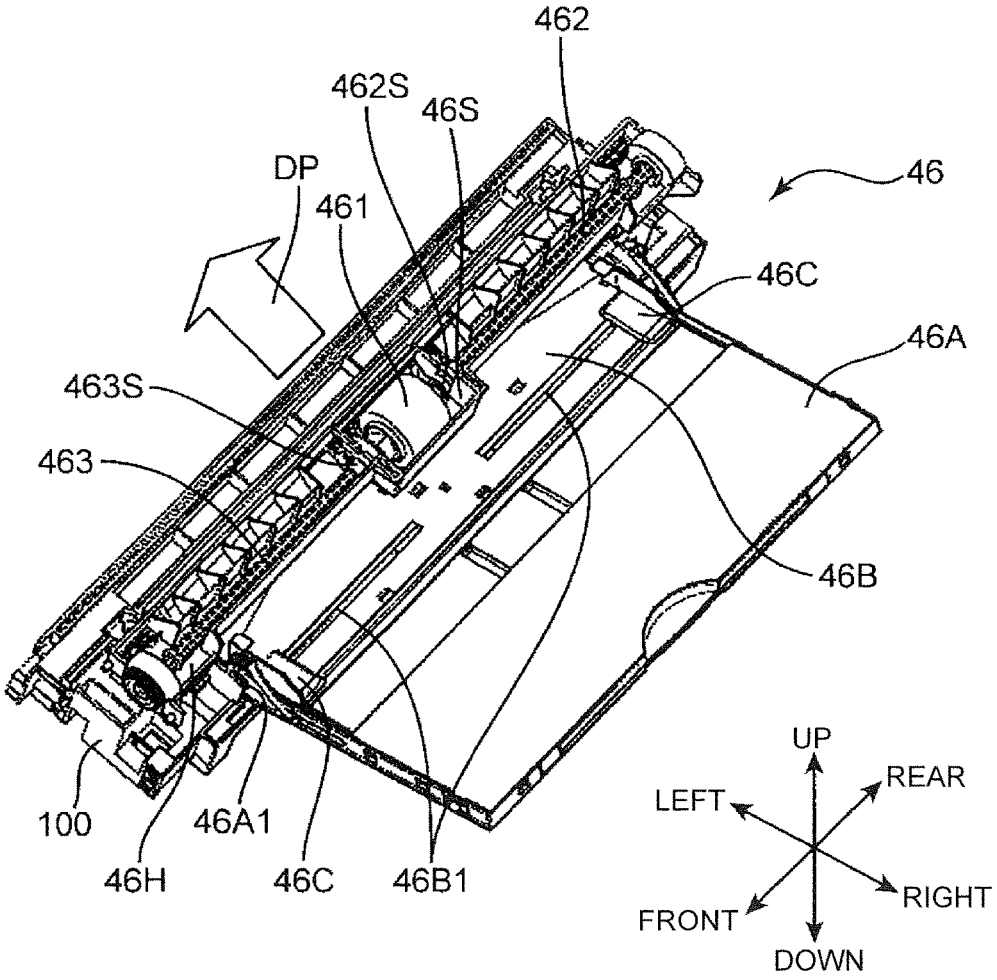
FIG. 2 is a perspective view of the manual paper feeder including the conveying roller unit according to one embodiment of the present invention.

Next, with reference to FIG. 2, the manual paper feeder 46 according to one embodiment of the present invention is described in detail. FIG. 2 is a perspective view of the manual paper feeder 46 according to this embodiment.

With reference to FIG. 2, the manual paper feeder 46 includes a main body unit 100, the manual feed tray 46A described above, a manual feed lift plate 46B, widthwise guides 46C, a housing 46H, the paper feed roller 461 described above, a drive shaft 462 (first shaft part), and a support shaft 463 (second shaft part).

The main body unit 100 is a casing disposed on the right side surface 1 OR of the apparatus main body 10 (FIG. 1). The main body unit 100 constitutes a part of the apparatus main body 10. As illustrated in FIG. 2, the main body unit 100 extends in the front and back direction with a predetermined width in the left and right direction. In the sheet transport direction downstream side of the manual feed tray 46A, the main body unit 100 defines a lower part of the manual sheet transport path 460 (FIG. 1). The sheet is guided leftward and upward by the main body unit 100 and the housing 46H described later.

The manual feed tray 46A described above is a plate-like member that can be opened and closed with respect to the main body unit 100. The manual feed tray 46A can turn about the pivot point 46A1 (FIG. 1). The sheet is transported from the manual feed tray 46A in an arrow DP direction in FIG. 2 (referred to also as a sheet transport direction, or simply as a transport direction).

The manual feed lift plate 46B forms a part of an upper surface part of the manual feed tray 46A and is disposed on the left side (transport direction downstream side) of the manual feed tray 46A. The left end part (transport direction downstream side end part) of the manual feed lift plate 46B can be moved up and down by a drive mechanism that is not shown. When the manual feed lift plate 46B is moved up and down, a front end part of the bunch of sheets placed on the manual feed tray 46A is moved upward. As a result, the front end part of the sheet contacts with the paper feed roller 461.

The widthwise guides 46C are disposed on the manual feed lift plate 46B. A pair of the widthwise guides 46C are disposed in the front and back direction so as to regulate the position of the sheet in the width direction. The widthwise guides 46C can move in the front and back direction along guide grooves 46B1 formed in the manual feed lift plate 46B via a rack and pinion gear that is not shown.

The housing 46H has a box-like shape extending in the front and back direction. The housing 46H is disposed above the main body unit 100. A lower end part of the housing 46H defines an upper part of the manual sheet transport path 460. In other words, a part of the manual sheet transport path 460 is formed between the housing 46H and the main body unit 100. The housing 46H includes a mounting part 46S for supporting the paper feed roller 461 in a rotatable manner in the middle part in the front and back direction.

The mounting part 46S has a shape in which the middle part in the front and back direction of the housing 46H partially protrudes rightward. Inside the mounting part 46S, there is formed a space for housing the paper feed roller 461. The mounting part 46S is opened upward and downward. The paper feed roller 461 is mounted in the mounting part 46S from above.

The drive shaft 462 is supported by the housing 46H in a rotatable manner on the rear side of the mounting part 46S. The drive shaft 462 is connected to a motor (drive unit) that is not shown. When the motor is driven, the drive shaft 462 is rotated so that the rotation drive force is transmitted to the paper feed roller 461. The drive shaft 462 has a first tip end part 462S. The first tip end part 462S is a front end part of the drive shaft 462. The first tip end part 462S is exposed to the mounting part 46S. The first tip end part 462S is equipped with a coupling claw that is not shown. The first tip end part 462S is connected to an engaging piece 523T described later of the paper feed roller 461.

The support shaft 463 is supported by the housing 46H on the front side of the mounting part 46S. The support shaft 463 has the same axis as the drive shaft 462 and is disposed on the opposite side to the drive shaft 462 with respect to the mounting part 46S. The support shaft 463 axially supports the paper feed roller 461 in a rotatable manner. The support shaft 463 has a second tip end part 463S. The second tip end part 463S is a rear end part of the support shaft 463. The second tip end part 463S is exposed to the mounting part 46S. The second tip end part 463S is equipped with a cylindrical bearing part that is not shown. The bearing part of the second tip end part 463S is connected to (axially supported by) an axially supported part 624 described later of the paper feed roller 461. Note that the support shaft 463 may be one that rotates integrally to the paper feed roller 461 in another embodiment.

The paper feed roller 461 (conveying roller unit) described above is disposed above the manual sheet transport path 460 so as to face the manual feed tray 46A. The paper feed roller 461 can be removably mounted to the mounting part 46S of the housing 46H. The paper feed roller 461 is connected to the first tip end part 462S of the drive shaft 462 and the second tip end part 463S of the support shaft 463, so as to be supported by the drive shaft 462 and the support shaft 463 in a rotatable manner. Then, the rotation drive force is transmitted from the first tip end part 462S to the paper feed roller 461, and hence the paper feed roller 461 rotates to transport the sheet. Note that when the paper feed roller 461 is removed from the mounting part 46S in FIG. 2, the space in the mounting part 46S is exposed. In this case, the first tip end part 462S is disposed at a predetermined interval with the second tip end part 463S in the front and back direction.

Figure 3:
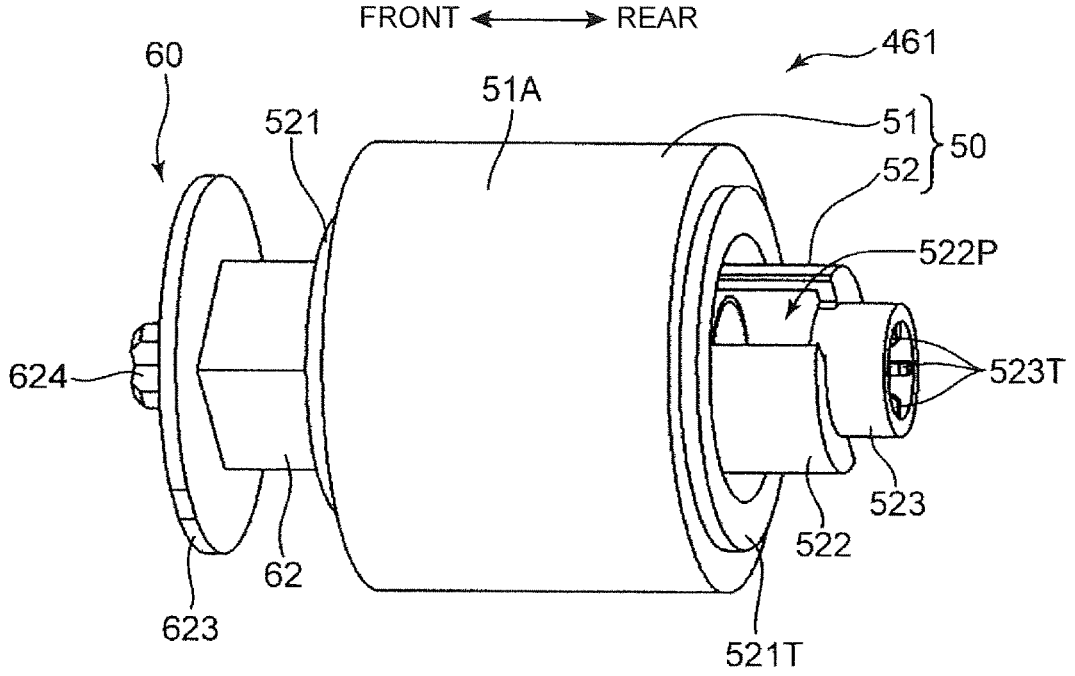
FIG. 3 is a perspective view of the conveying roller unit according to this embodiment.
Figure 4:
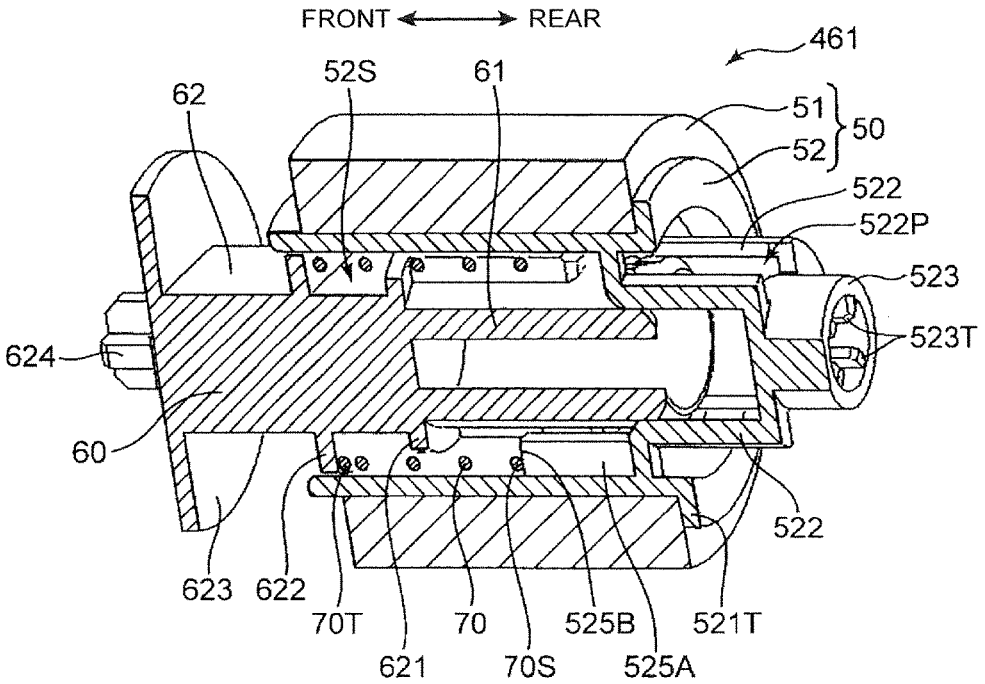
FIG. 4 is a cross-sectional perspective view of the conveying roller unit of this embodiment.
Figure 5:
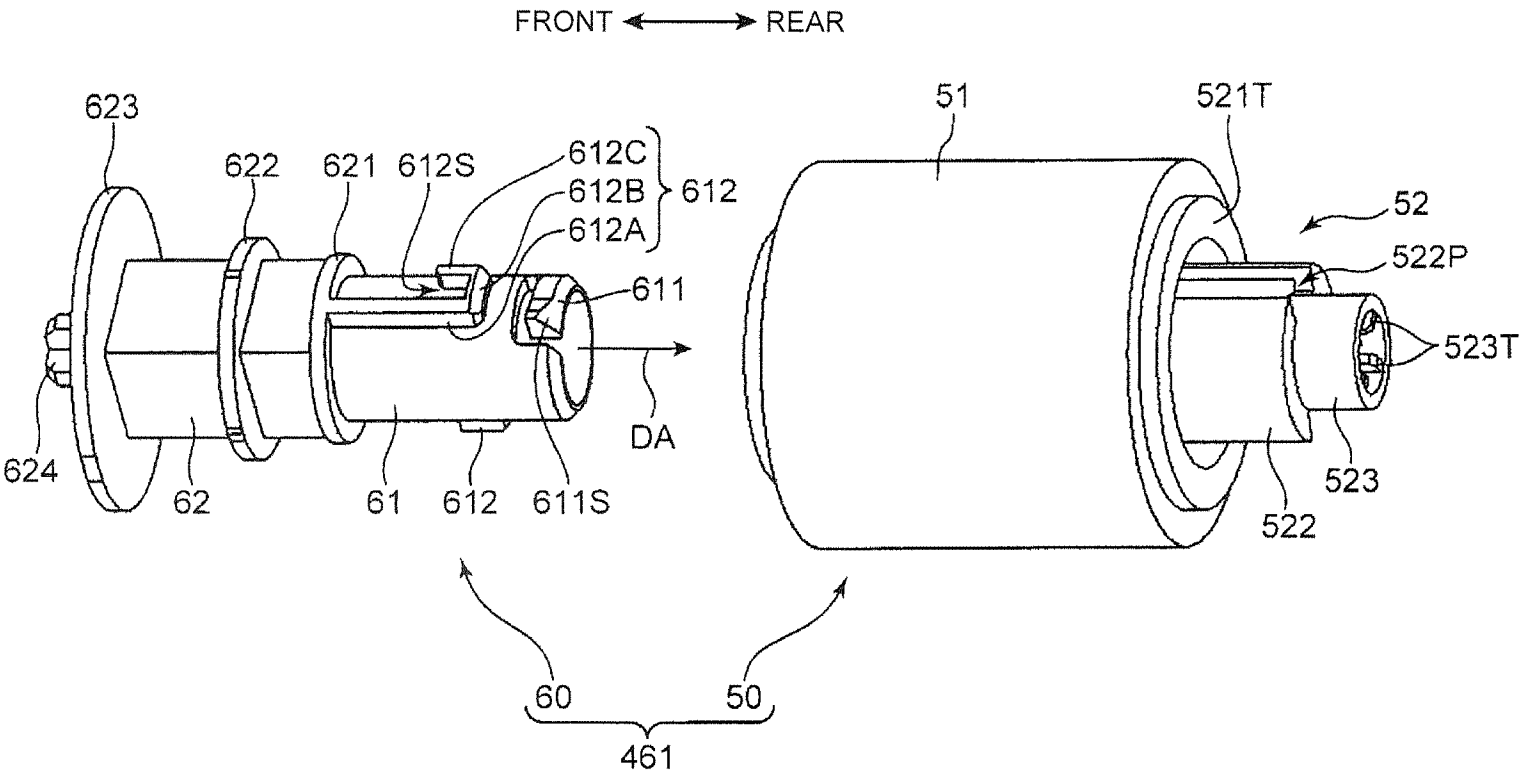
FIG. 5 is an exploded perspective view of the conveying roller unit of this embodiment.
Figure 6:
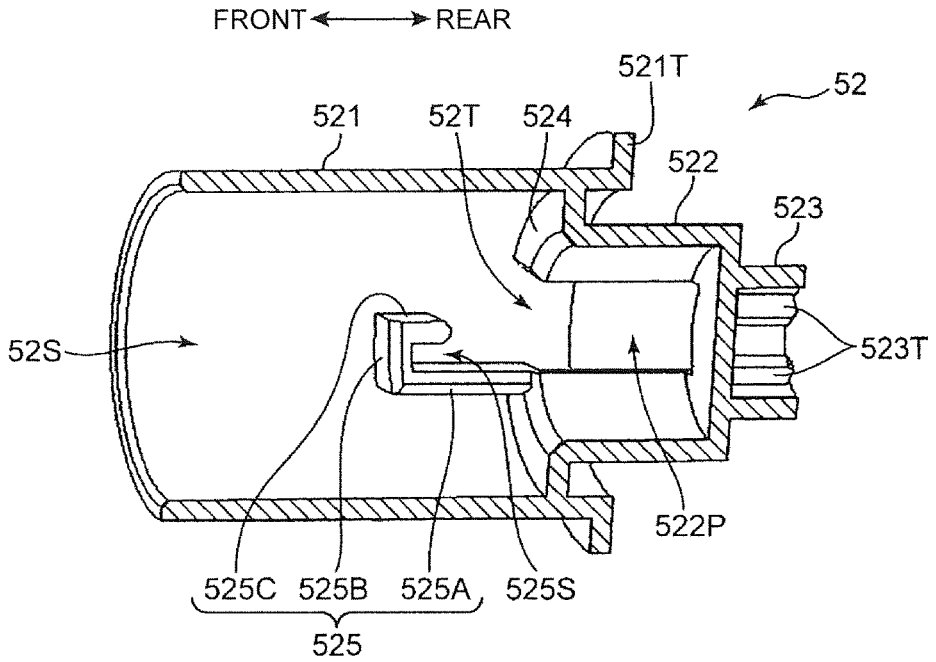
FIG. 6 is a cross-sectional perspective view of a part of a first unit of the conveying roller unit of this embodiment.

Next, with reference to FIGS. 3 to 6, the paper feed roller 461 according to this embodiment is described in detail. FIG. 3 is a perspective view of the paper feed roller 461 according to this embodiment. FIG. 4 is a cross-sectional perspective view of the paper feed roller 461. In addition, FIG. 5 is an exploded perspective view of the paper feed roller 461. Further, FIG. 6 is a cross-sectional perspective view of a holder section 52 of a first unit 50 of the paper feed roller 461. The paper feed roller 461 includes the first unit 50, a second unit 60, and a spring 70 (pressing member) (FIG. 4).

The first unit 50 is disposed on the rear end side of the paper feed roller 461. The first unit 50 includes a roller section 51 and a holder section 52. The roller section 51 is a cylindrical member made of an elastic material and is mounted to the holder section 52. The roller section 51 has a circumferential surface 51A (FIG. 3). The circumferential surface 51A can contact with the sheet.

The holder section 52 supports the roller section 51. The holder section 52 (FIG. 6) has a cylindrical shape with an opened front side. The holder section 52 includes a first cylindrical part 521, a second cylindrical part 522, a third cylindrical part 523, a connecting wall 524 (wall part), and a first engagement section 525 (first protruding part). As illustrated in FIG. 6, the first cylindrical part 521, the second cylindrical part 522, and the third cylindrical part 523 are cylindrical parts forming an outer circumferential part of the holder section 52. The outer diameter of the holder section 52 is decreased step by step from the first cylindrical part 521 to the third cylindrical part 523. Note that inside of the first cylindrical part 521 and inside of the second cylindrical part 522 are communicated to each other. Between the second cylindrical part 522 and the third cylindrical part 523 is blocked. Further, a unit inside space 52S (inside space) is formed inside the first cylindrical part 521 and the second cylindrical part 522. The unit inside space 52S has the opened front end side (the other end side in the rotation axis direction of the paper feed roller 461) as described above. Further, an insertion cylindrical part 61 described later of the second unit 60 is inserted into the unit inside space 52S of the first unit 50 along the insertion direction (an arrow DA in FIG. 5) from the front side to the rear side (from the other end side to one end side in the axis direction).

The connecting wall 524 is the wall part that connects the rear end side of the first cylindrical part 521 and the front end side of the second cylindrical part 522. The connecting wall 524 extends to expand in a rotation radial direction of the paper feed roller 461. In other words, the connecting wall 524 is a wall part provided to protrude inward in the radial direction from the inner circumferential surface of the first cylindrical part 521. Note that the rear end part of the first cylindrical part 521 extends further from the connecting wall 524 to the rear side as illustrated in FIG. 6.

The first engagement section 525 is a protruding part provided to protrude inward in the radial direction from the inner circumferential surface of the holder section 52 of the first unit 50. The first engagement section 525 has a U-shaped hook shape with an opened tip end side in the insertion direction (rear side). Specifically, the first engagement section 525 includes a first ridge part 525A, a second ridge part 525B, and a third ridge part 525C. The first ridge part 525A extends along the insertion direction. Note that the rear end part of the first ridge part 525A is connected to the connecting wall 524 (FIG. 6). The second ridge part 525B extends from the insertion direction rear end part of the first ridge part 525A (front end side of the first ridge part 525A) in the circumferential direction of the holder section 52. Note that the direction in which the second ridge part 525B extends from the first ridge part 525A corresponds to the second rotation direction (arrow DT direction in FIG. 8) described later. The third ridge part 525C extends from the tip end part of the second ridge part 525B (the second rotation direction downstream side end part) to the rear side (the insertion direction front end side). Note that the third ridge part 525C is shorter than the first ridge part 525A. In addition, among the first ridge part 525A, the second ridge part 525B, and the third ridge part 525C, there is formed a first recess part 525S (FIG. 6) corresponding to the opening of the hook shape of the first engagement section 525. Note that the second ridge part 525B of the first engagement section 525 abuts a rear end part of the spring 70 described later and compresses the spring 70 between itself and the second unit 60.

Further, the first cylindrical part 521 includes a first flange 5211. The first flange 521T is a flange part formed over the entire circumferential direction by expanding the outer diameter of the rear end part of the first cylindrical part 521. As illustrated in FIGS. 3 and 4, the first flange 521T restricts a position of the rear end part of the roller section 51 mounted to the holder section 52. In addition, the second cylindrical part 522 includes a guide groove 522P (FIGS. 3 and 6). The guide groove 522P is positioned on the rear side (insertion direction front end side) of the first engagement section 525 so as to communicate the outside of the first unit 50 and the unit inside space 52S. As illustrated in FIG. 6, the guide groove 522P opens in a rectangular shape in the circumferential surface of the second cylindrical part 522. In addition, with reference to FIG. 6, inside the holder section 52, a part of the connecting wall 524 in the circumferential direction is cut out to form an entrance space 52T that enables a second engagement section 612 described later to enter the guide groove 522P side.

Further, the third cylindrical part 523 includes the engaging piece 523T (first connection section) inside. The engaging piece 523T is disposed on one end side in the axis direction of the paper feed roller 461 (the rear end side of the paper feed roller 461). The engaging piece 523T can connect to the first tip end part 462S of the drive shaft 462 (see FIG. 2). Specifically, the engaging piece 523T is a plurality of protruding pieces provided to protrude from the inner circumferential surface of the third cylindrical part 523 with intervals in the circumferential direction (FIG. 3). The engaging piece 523T is engaged with the coupling claw provided to the first tip end part 462S. The engagement between the engaging piece 523T and the coupling claw enables transmission of the rotation drive force from the drive shaft 462 to the paper feed roller 461.

The second unit 60 is disposed on the front end side of the paper feed roller 461 and can be removably mounted to the first unit 50. The second unit 60 includes the insertion cylindrical part 61 (rod section) and a prism part 62. The insertion cylindrical part 61 is a cylindrical part disposed on the front end side in the insertion direction (arrow DA direction in FIG. 5) of the second unit 60. The tip end part of the insertion cylindrical part 61 is opened. When the second unit 60 is mounted to the first unit 50, the insertion cylindrical part 61 is inserted into the unit inside space 52S of the first unit 50. The insertion cylindrical part 61 includes an engaging claw 611 (engaging piece) and the second engagement section 612 (second protruding part).

The engaging claw 611 is a claw part formed in the tip end part of the insertion cylindrical part 61 along the circumferential surface. As illustrated in FIG. 5, a part of a distal end rim of the insertion cylindrical part 61 is cut out in the axis direction and in the circumferential direction so that the engaging claw 611 is formed. The elongated engaging claw 611 can be elastically deformed inward in the radial direction of the second unit 60. The engaging claw 611 has a claw tip end part 611S (tip end part). The claw tip end part 611S is a protrusion having a substantially triangular shape provided to protrude from the tip of the engaging claw 611 outward in the radial direction. A radial direction outer end part of the claw tip end part 611S is protruded from the outer circumferential surface of the insertion cylindrical part 61. Note that the engaging claw 611 is disposed on the insertion direction front end side of the second unit 60 with respect to the second engagement section 612.

The second engagement section 612 is a protruding part provided to protrude outward in the radial direction from the outer circumferential surface of the insertion cylindrical part 61 of the second unit 60. The first engagement section 525 has a U-shaped hook shape with an opened rear end in the insertion direction. Note that in this embodiment, a pair of the second engagement sections 612 are disposed at axially symmetric positions on the outer circumferential surface of the insertion cylindrical part 61. In FIG. 5, one of the second engagement sections 612 is shown entirely, while the other of the second engagement sections 612 is shown partially. The pair of the second engagement sections 612 have the same shape.

The second engagement section 612 includes a fourth ridge part 612A, a fifth ridge part 612B, and a sixth ridge part 612C. The fourth ridge part 612A extends along the insertion direction. The front end side of the fourth ridge part 612A is connected to a second flange 621 described later (FIG. 5). The fifth ridge part 612B extends from the front end side of the fourth ridge part 612A (the insertion direction tip end part of the fourth ridge part 612A) along the circumferential direction of the second unit 60. Note that the direction in which the fifth ridge part 612B extends from the fourth ridge part 612A corresponds to a first rotation direction described later (arrow DS direction in FIG. 7). The sixth ridge part 612C extends from the tip end part of the fifth ridge part 612B (the first rotation direction downstream side end part) to the front side (the insertion direction rear end side). The sixth ridge part 612C is shorter than the fourth ridge part 612A. In addition, a second recess part 612S (FIG. 5) corresponding to an opening of the hook shape of the second engagement section 612 is formed among the fourth ridge part 612A, the fifth ridge part 612B, and the sixth ridge part 612C. Further, as illustrated in FIG. 5, the fifth ridge part 612B is disposed with an interval from the engaging claw 611 in the axis direction of the second unit 60.

The prism part 62 is disposed on the insertion direction rear end side of the second unit 60 (arrow DA direction in FIG. 5) and is connected to the insertion cylindrical part 61. The prism part 62 includes the second flange 621 (restricting projection), a third flange 622, a fourth flange 623, and an axially supported part 624 (second connection section). The second flange 621 is formed over the entire circumferential direction of the rear end part of the prism part 62. The second flange 621 is connected to the fourth ridge part 612A described above (FIG. 5). In addition, the second flange 621 is provided to protrude on the insertion direction rear end side of the second engagement section 612 and functions as the restricting projection described later. The third flange 622 is formed over the entire circumferential direction on the front side of the second flange 621 with an interval. The outer diameter of the third flange 622 is set to be larger than the outer diameter of the second flange 621. Further, the fourth flange 623 is formed over the entire circumferential direction on the front end side of the prism part 62. The outer diameter of the fourth flange 623 is set to be still larger than the outer diameter of the third flange 622. Note that the third flange 622 abuts the front end side of the spring 70 described later and compresses the spring 70 between itself and the first unit 50.

The axially supported part 624 (FIGS. 4 and 5) is a protruding part provided to protrude frontward from the center of the fourth flange 623. The axially supported part 624 has a cross shape in the cross-sectional view perpendicular to the axis direction of the second unit 60. The axially supported part 624 can be connected to the second tip end part 463S of the support shaft 463 (see FIG. 2). Specifically, when the axially supported part 624 is inserted into the bearing part that is provided to the second tip end part 463S but is not shown, the paper feed roller 461 is axially supported by the support shaft 463 in a rotatable manner.

Note that the first engagement section 525 of the first unit 50, the second engagement section 612 of the second unit 60, and the spring 70 constitute the lock mechanism in this embodiment. The lock mechanism has a function of locking the first unit 50 and the second unit 60 in an integrally rotatable manner.

The spring 70 (FIG. 4) is a coil spring that is disposed in the unit inside space 52S and is compressed between the first unit 50 and the second unit 60. The spring 70 is disposed between the outer circumferential surface of the rear end part of the prism part 62 as well as the insertion cylindrical part 61 and the inner circumferential surface of the first cylindrical part 521 (FIG. 6). The spring 70 includes a spring tip end part 70S and a spring proximal end part 70T. The spring tip end part 70S is a rear side end part of the spring 70 and abuts the second ridge part 525B of the first engagement section 525 of the first unit 50. In addition, the spring proximal end part 70T is a front side end part of the spring 70 and abuts the third flange 622 of the second unit 60. Note that the second flange 621 of the second unit 60 is disposed in the inner side of the spring 70 in the radial direction (FIG. 4). When the second unit 60 is inserted into the unit inside space 52S of the first unit 50, the spring 70 is compressed between the third flange 622 and the second ridge part 525B. As a result, the spring 70 presses the second unit 60 in the direction that the insertion cylindrical part 61 of the second unit 60 moves out of the unit inside space 52S.

Figure 7:
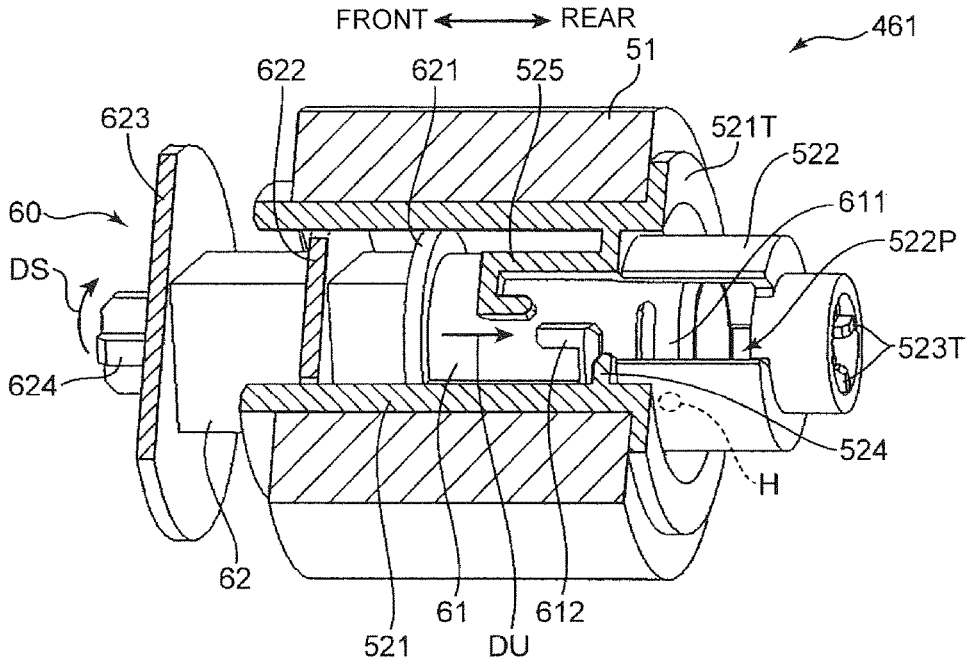
FIG. 7 is a cross-sectional perspective view illustrating a state where a second unit is positioned at a first position in the conveying roller unit of this embodiment.
Figure 8:
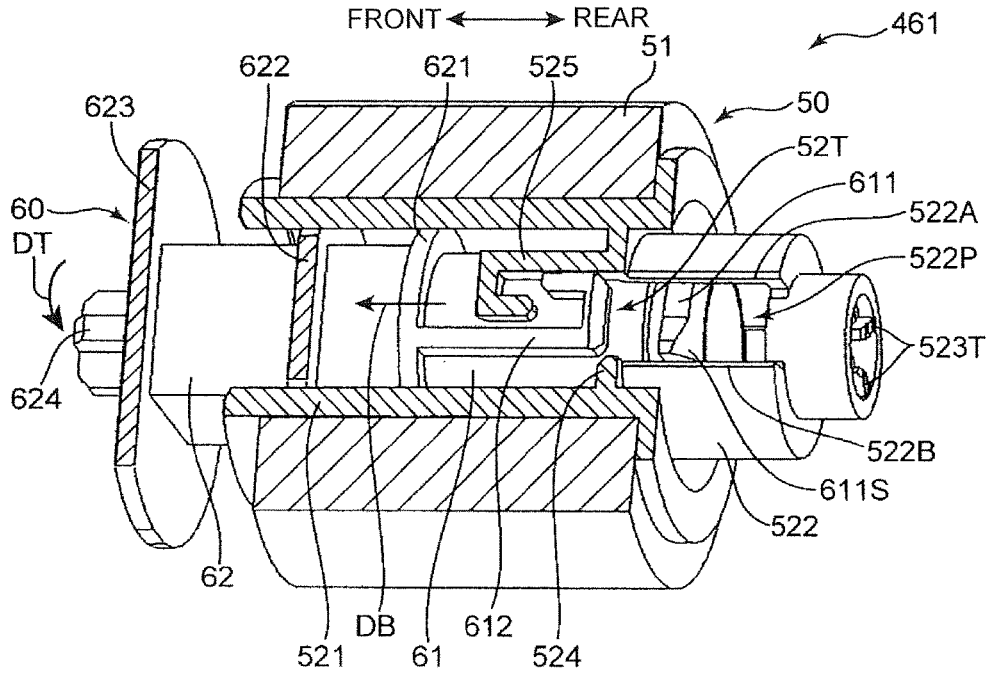
FIG. 8 is a cross-sectional perspective view illustrating a state where the second unit is positioned at a second position in the conveying roller unit of this embodiment.
Figure 9:
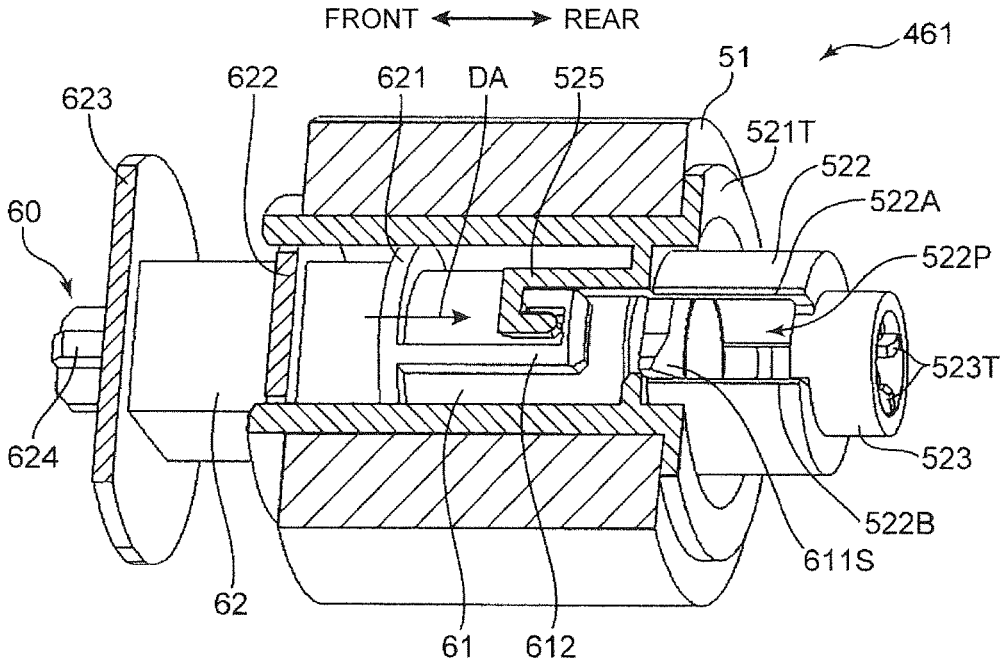
FIG. 9 is a cross-sectional perspective view illustrating a state where the second unit is positioned at a third position in the conveying roller unit of this embodiment.
Figure 10:
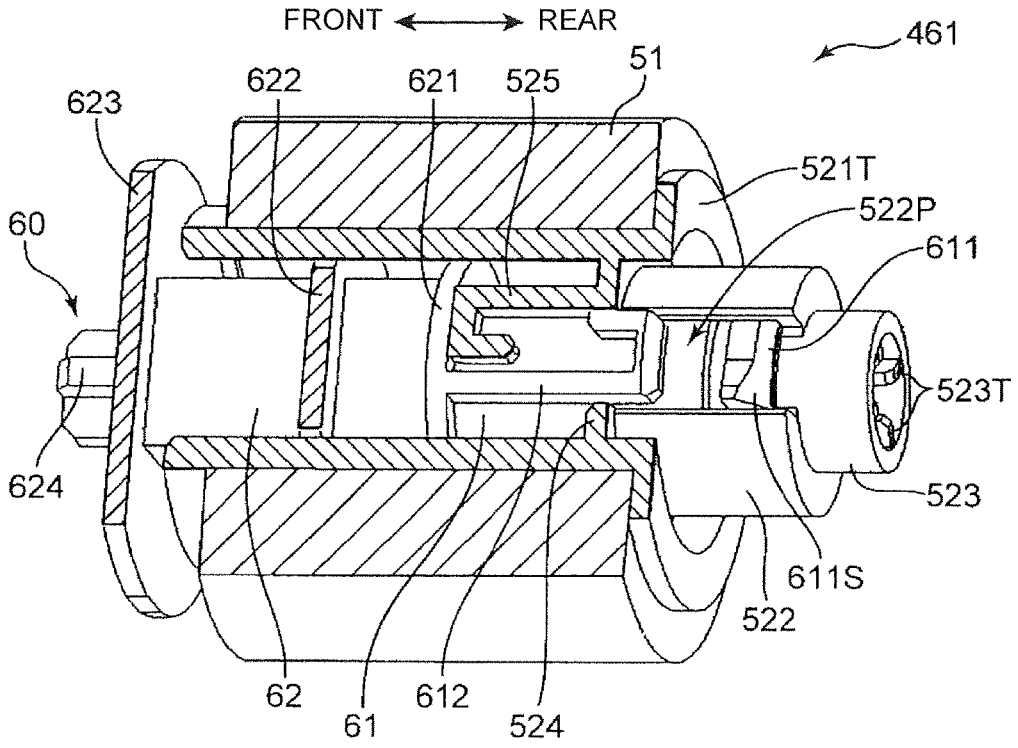
FIG. 10 is a cross-sectional perspective view illustrating a state where the second unit is positioned at a fourth position in the conveying roller unit of this embodiment.

Next, with reference to FIGS. 7 to 10 in addition to FIGS. 3 to 6, assembly of the paper feed roller 461 and mounting of the paper feed roller 461 to the mounting part 46S are described. FIG. 7 is a cross-sectional perspective view of the paper feed roller 461 according to this embodiment in the state where the second unit 60 is positioned at a first position in the first unit 50. FIG. 8 is a cross-sectional perspective view in the state where the second unit 60 is positioned at a second position in the first unit 50. FIG. 9 is a cross-sectional perspective view in the state where the second unit 60 is positioned at a third position in the first unit 50. FIG. 10 is a cross-sectional perspective view in the state where the second unit 60 is positioned at a fourth position in the first unit 50.

With reference to FIG. 8, the second cylindrical part 522 of the first unit 50 further includes a first end edge 522A and a second end edge 522B (end edge) (FIG. 8). The first end edge 522A is an end edge that defines the downstream side in the first rotation direction (arrow DS direction in FIG. 7) of the guide groove 522P. Similarly, the second end edge 522B is an end edge that defines the upstream side in the first rotation direction of the guide groove 522P. The first end edge 522A and the second end edge 522B extend in the front and back direction.

When the paper feed roller 461 is mounted to the mounting part 46S of the housing 46H, the second unit 60 is first mounted to the first unit 50. In advance, in the state where the spring 70 is engaged around the insertion cylindrical part 61 of the second unit 60, the insertion cylindrical part 61 of the second unit 60 is inserted into the unit inside space 52S of the first unit 50 (arrow DA in FIG. 5). In this case, the insertion cylindrical part 61 of the second unit 60 is inserted to the first position of the unit inside space 52S of the first unit 50 while compressing the spring 70 (FIG. 7). Specifically, the sixth ridge part 612C of the second engagement section 612 (FIG. 5) enters in the upstream side area in the first rotation direction (arrow DS direction in FIG. 7) of the third ridge part 525C of the first engagement section 525 (FIG. 6) to the insertion direction front end side (arrow DU in FIG. 7) farther than the third ridge part, and hence the insertion cylindrical part 61 of the second unit 60 reaches the first position (FIG. 7). In this case, in this embodiment, the fifth ridge part 612B of the second engagement section 612 abuts the connecting wall 524 (FIG. 7), and hence the insertion cylindrical part 61 is prevented from being inserted farther than the first position to the insertion direction front end side. Therefore, the operator can easily grasp that the insertion cylindrical part 61 has reached the first position and can smoothly move to rotating operation described later.

Note that, when the insertion cylindrical part 61 of the second unit 60 is inserted to the first position in FIG. 7, the engaging claw 611 is elastically deformed inward in the radial direction in a state where the claw tip end part 611S of the engaging claw 611 of the second unit 60 abuts the inner circumferential surface of the second cylindrical part 522. In this case, the claw tip end part 611S is disposed in the area shown by a broken line H in FIG. 7.

Note that the first engagement section 525 of the first unit 50 and the second engagement section 612 of the second unit 60 are disposed on circles having the same radius from the same rotation center of the paper feed roller 461. For this reason, when the insertion cylindrical part 61 of the second unit 60 is inserted in the unit inside space 52S, there may be a case where the fifth ridge part 612B of the second engagement section 612 abuts the second ridge part 525B of the first engagement section 525 so that the insertion cylindrical part 61 is prevented from entering. In this case, the operator rotates the second unit 60 in the circumferential direction, and hence the position in the circumferential direction of the first engagement section 525 is shifted from that of the second engagement section 612. As a result, the insertion cylindrical part 61 can be inserted to the first position as described above.

When the operator rotates the second unit 60 from the first position shown in FIG. 7 with respect to the first unit 50 in the first rotation direction (arrow DS in FIG. 7) along the circumferential direction in rotation of the paper feed roller 461, the sixth ridge part 612C reaches the first rotation direction downstream side of the third ridge part 525C, and the insertion cylindrical part 61 is positioned at the second position shown in FIG. 8. Note that the first ridge part 525A extends long to connect to the connecting wall 524 as illustrated in FIG. 6. For this reason, as illustrated in FIG. 8, the sixth ridge part 612C (FIG. 5) of the second engagement section 612 abuts the first ridge part 525A of the first engagement section 525 (FIG. 6) so that the rotating operation of the second unit 60 is stopped. Therefore, the operator can easily grasp that the second unit 60 has reached the second position.

In addition, when the insertion cylindrical part 61 reaches the second position, the claw tip end part 611S of the engaging claw 611 protrudes to the guide groove 522P of the first unit 50, and the claw tip end part 611S engages with the second end edge 522B (FIG. 8). The engaging claw 611 has a so-called snap-fit structure. For this reason, when the claw tip end part 611S abuts the second end edge 522B, rotation in the second rotation direction (arrow DT in FIG. 8) opposite to the first rotation direction of the second unit 60 is restricted by a predetermined restricting force. Therefore, except for an operator's intentional detaching work, the second unit 60 that has reached the second position is prevented from being detached from the first unit 50 by mistake. In addition, because the guide groove 522P is exposed to the outside of the paper feed roller 461, the operator can visually check the state where the claw tip end part 611S protrudes to the guide groove 522P. Further, when the first unit 50 and the second unit 60 are assembled, the mounting position (engaging position) of the second unit to the first unit in the circumferential direction can be sensed as click feeling when the claw tip end part 611S fits in the guide groove 522P, and thus workability can be improved. Therefore, assembly of the paper feed roller 461 can be easily and securely performed.

When the operator decreases grip force for the second unit 60 in the state where the insertion cylindrical part 61 of the second unit 60 has reached the second position of FIG. 8, the insertion cylindrical part 61 is moved by the pressing force of the spring 70 to the third position (FIG. 9) on the inlet side of the second position in the unit inside space 52S (arrow DB in FIG. 8). Further, in the state where the second unit 60 is positioned at the third position, the engaging piece 523T and the axially supported part 624 of the paper feed roller 461 (FIG. 3) are connected to the first tip end part 462S of the drive shaft 462 and the second tip end part 463S of the support shaft 463 (FIG. 2), respectively. As a result, the paper feed roller 461 is driven to rotate in the manual paper feeder 46. In other words, in this embodiment, the state illustrated in FIG. 9 corresponds to a normal use state of the paper feed roller 461.

Note that, when the second unit 60 reaches the third position of FIG. 9, one end part (the sixth ridge part 612C) of the second engagement section 612 enters the first recess part 525S between the first ridge part 525A and the third ridge part 525C (FIG. 6) of the first engagement section 525, and hence the first engagement section 525 and the second engagement section 612 are engaged with each other. As a result, on the front side and in the circumferential direction, the position of the second unit 60 with respect to the first unit 50 is restricted so that the first unit 50 and the second unit 60 are locked to each other. In particular, in this embodiment, because the tip end part of the sixth ridge part 612C abuts the second ridge part 525B of the first engagement section 525 by the pressing force of the spring 70, the position of the second unit 60 with respect to the first unit 50 on the front end side is restricted. Therefore, the second unit 60 is prevented from dropping out from the first unit 50 by mistake. In addition, because the sixth ridge part 612C abuts the first ridge part 525A or the third ridge part 525C, the position of the second unit 60 with respect to the first unit 50 in the circumferential direction is restricted. For this reason, the first unit 50 and the second unit 60 are easily and securely locked to each other so that the first unit 50 and the second unit 60 can be stably rotated in an integrated manner in the manual paper feeder 46.

In the state illustrated in FIG. 9, in the axis direction of the paper feed roller 461, the length between the axially supported part 624 and the engaging piece 523T is larger than the distance between the first tip end part 462S and the second tip end part 463S in the mounting part 46S (FIG. 2). Therefore, it is difficult to insert the paper feed roller 461 into the mounting part 46S. For this reason, the operator grips both end parts of the paper feed roller 461 in the front and back direction, so that the second unit 60 is further inserted deeply in the unit inside space 52S (arrow DA in FIG. 9) of the paper feed roller 461 assembled in the state of FIG. 9. As a result, the insertion cylindrical part 61 of the second unit 60 positioned at the third position (FIG. 9) is further inserted into the unit inside space 52S while pressing the spring 70, so as to reach the fourth position (FIG. 10) via the second position (FIG. 8). Further, because the length of the paper feed roller 461 in the axis direction becomes smaller than that in the case where the second unit 60 is positioned at the third position, the paper feed roller 461 can be easily inserted between the first tip end part 462S and the second tip end part 463S of the mounting part 46S.

Note that, in this embodiment, when the insertion cylindrical part 61 is moved to the insertion direction front end side farther than the second position (FIG. 8), the second flange 621 (restricting projection) of the second unit 60 abuts the second ridge part 525B of the first engagement section 525 (FIG. 10). Therefore, the second unit 60 is prevented from being inserted further than the fourth position to the insertion direction front end side. The operator can easily grasp that the length of the paper feed roller 461 in the axis direction is decreased so that the paper feed roller 461 can be mounted in the mounting part 46S.

When the operator decreases grip force for the paper feed roller 461 in the state illustrated in FIG. 10 after the paper feed roller 461 is inserted in the mounting part 46S, the paper feed roller 461 is expanded in the axis direction again by the pressing force of the spring 70. Further, when the insertion cylindrical part 61 of the second unit 60 is moved from the fourth position (FIG. 10) to the third position (FIG. 9), the engaging piece 523T is connected to the first tip end part 462S, and the axially supported part 624 is easily connected to the second tip end part 463S. As a result, the paper feed roller 461 is mounted in the mounting part 46S in a rotatable manner. In this case, the pressing force of the spring 70 is applied in the direction that the second engagement section 612 is strongly engaged with the first engagement section 525. Therefore, the second unit 60 is prevented from being detached from the first unit 50 after being mounted to the mounting part 46S.

Note that, when the insertion cylindrical part 61 moves between the third position illustrated in FIG. 9 and the fourth position illustrated in FIG. 10, the claw tip end part 611S of the engaging claw 611 of the second unit 60 abuts the second end edge 522B (FIG. 8). For this reason, the claw tip end part 611S can guide the movement of the second unit 60 along the insertion direction. Therefore, the insertion cylindrical part 61 of the second unit 60 can smoothly move among the second, third, and fourth positions. Note that the first ridge part 525A of the first engagement section 525 and the sixth ridge part 612C of the second engagement section 612 also contact with each other and hence have the same guide function.

As described above, according to this embodiment, when the insertion cylindrical part 61 of the second unit 60 reaches the third position via the first position and the second position in the unit inside space 52S of the first unit 50, the first unit 50 and the second unit 60 can be locked. As a result, the first unit 50 and the second unit 60 are prevented from being detached from each other by mistake, and the paper feed roller 461 can stably rotate in the mounting part 46S. In addition, because the first unit 50 and the second unit 60 are locked to each other by engagement between the first engagement section 525 and the second engagement section 612, plastic deformation of a lock member can be prevented compared with the case where the two units are locked to each other by the lock member that is elastically deformed like snap-fit. Note that, in this embodiment too, elastic deformation occurs when the paper feed roller 461 is mounted in the mounting part 46S, because the engaging claw 611 has a snap-fit structure. However, as described above, when the paper feed roller 461 is used in the manual paper feeder 46, because the claw tip end part 611S protrudes to the guide groove 522P, the elastically deformed engaging claw 611 restores the original shape by the restoring force. In addition, in the state where the first engagement section 525 and the second engagement section 612 are engaged with each other, the pressing force of the spring 70 does not act on the engaging claw 611 in the axis direction. In this way, plastic deformation or breakage of the engaging claw 611 is prevented.

In addition, in this embodiment, rotation of the second unit 60 in the second rotation direction is restricted at the second position (FIG. 8) between the third position (FIG. 9) at which the paper feed roller 461 is rotated and the fourth position (FIG. 10) at which the paper feed roller 461 is compressed for mounting. In other words, rotation of the second unit 60 is allowed at other positions between the third position and the fourth position. For this reason, both in the state where the paper feed roller 461 is mounted in the mounting part 46S and in the state of the single paper feed roller 461 after being removed from the mounting part 46S, the second unit 60 is prevented from dropping out from the first unit 50 by mistake. Note that, the operator can remove the paper feed roller 461 from the mounting part 46S by moving the second unit 60 from the third position to the fourth position again so that the length of the paper feed roller 461 in the axis direction is decreased. After that, the second unit 60 can be separated from the first unit 50 after moving from the third position to the first position via the second position again.

Although the manual paper feeder 46 according to the embodiment of the present invention and the image forming apparatus 1 including the manual paper feeder 46 are described above, the present invention is not limited to this. For example, it is possible to adopt the following modified embodiments.

(1) In the embodiment described above, the manual paper feeder 46 is described as the paper feeding device, but the present invention is not limited to this structure. The present invention may be applied to the automatic document feeder 20 (paper feeding device) as the paper feeding device for transporting sheets as a document. In this case, the reading unit 25 (reader) and the automatic document feeder 20 both described above constitute the image reading device 2. The reading unit is disposed to face the sheet transport path extending from the document tray 21. Further, the paper feed roller 461 is removably mounted to the automatic document feeder 20, and hence breakage of the paper feed roller 461 is prevented so that the documents sheets can be stably transported to the reading unit 25. In this case too, breakage of the paper feed roller 461 is prevented, and images of the document sheets can be stably read.

(2) In the embodiment described above, the first engagement section 525 and the second engagement section 612 have the U-shaped hook shape, but the present invention is not limited to this structure. The first engagement section 525 and the second engagement section 612 may have a V-shaped hook shape or may be other protruding parts that engage with each other.

(3) In the embodiment described above, in the paper feed roller 461, the first unit 50 is connected to the drive shaft 462, while the second unit 60 is connected to the support shaft 463, but the present invention is not limited to this structure. It is possible to adopt a structure in which the first unit 50 is connected to the support shaft 463, while the second unit 60 is connected to the drive shaft 462. In this case, the second unit 60 and the first unit 50 should have shapes of the engaging piece 523T and the axially supported part 624, respectively.

According to the present invention, it is possible to provide the sheet feed device in which the conveying roller unit that can be removably mounted to the housing is prevented from being broken, so that the sheets can be stably transported, and to provide the image forming apparatus including the sheet feed device.

The invention claimed is:

1. A conveying roller unit comprising:

a first unit including a cylindrical roller section capable of abutting a sheet, and a hollow cylindrical holder section having an outer circumferential surface on which the roller section is mounted, a first connection section disposed on one end side in a rotation axis direction, and an opening on the other end side; and a second unit capable of being removably mounted to the first unit, the second unit including a second connection section disposed on the other end side of the first unit in the rotation axis direction, and a rod section to be inserted to the inside of the holder section along an insertion direction from the other end side to the one end side in the rotation axis direction; and a lock mechanism which locks the second unit to the first unit in an integrally rotatable manner, wherein the lock mechanism includes a first engagement section provided to protrude from an inner circumferential surface of the holder section of the first unit, a second engagement section provided to protrude from an outer circumferential surface of the rod section of the second unit, so as to be capable of engaging with the first engagement section, and a urging member disposed inside the holder section so as to press the second unit in the direction that the rod section moves out of the holder section, wherein a urging force of the urging member maintains engagement between the first engagement section and the second engagement section, and positions of the second unit in the circumferential direction and in the rotation axis direction with respect to the first unit are restricted so that the second unit is locked to the first unit, and when the rod section is inserted to the first position of the holder section against the urging force of the urging member, with an external force applied to the second unit, and the external force is removed after the rod section is moved to a second position rotated from the first position in a first rotation direction along the circumferential direction of the holder section, then the rod section is moved to a third position by the urging force closer to the holder opening side than the second position, and the first engagement section and the second engagement section are engaged with each other at the third position.

2. The conveying roller unit according to claim 1, wherein the holder section includes a first cylindrical part and a second cylindrical part having a smaller diameter than the first cylindrical part and protruding from the first cylindrical part toward one end side in the rotation axis direction, the second cylindrical part includes a guide groove positioned on a front end side of the first engagement section so as to penetrate from inside to outside of the holder section, and an end edge defining a first rotation direction upstream side of the guide groove, the rod section includes an engaging piece formed along an outer circumferential surface on the front end side of the second engagement section in the insertion direction, the engaging piece has a tip end part protruding outward in the radial direction from the outer circumferential surface of the rod section and is capable of elastically deforming inward in the radial direction, when the rod section is inserted to the first position of the holder section, the engaging piece is elastically deformed inward in the radial direction while abutting the inner circumferential surface of the holder section, and when the rod section is moved from the first position to the second position, the tip end part of the engaging piece is engaged with the guide groove, and the tip end part abuts the end edge of the guide groove so that rotation of the second unit in a second rotation direction opposite to the first rotation direction is restricted.

3. The conveying roller unit according to claim 2, wherein the second unit moves in a reciprocating manner with respect to the first unit in the insertion direction or in the direction opposite to the insertion direction in a state where the tip end part of the engaging piece abuts the end edge of the guide groove.

4. A sheet feed device comprising:

the conveying roller unit according to claim 3;

a housing having a mounting part to which the conveying roller unit is mounted;

a first shaft part having a first tip end part exposed to the mounting part, the first shaft part supported by the housing in a rotatable manner; and a second shaft part having a second tip end part exposed to the mounting part, the second shaft part supported by the housing on the same axis as the first shaft part on the opposite side to the first shaft part with respect to the mounting part, wherein the first connection section is connected to one of the first tip end part and the second tip end part, while the second connection section is connected to the other of the first tip end part and the second tip end part so that a rotation drive force is transmitted to the conveying roller unit for conveying a sheet.

5. The conveying roller unit according to claim 2, wherein the first engagement section has a hook shape with an opening on the front end side, while the second engagement section has a hook shape with an opening on a rear end side in the insertion direction, and when the rod section moves from the second position to the third position, a front end part of the first engagement section in the insertion direction enters the opening of the second engagement section, and a rear end part of the second engagement section enters the opening of the first engagement section, so that the first engagement section and the second engagement section are engaged with each other.

6. A sheet feed device comprising:

the conveying roller unit according to claim 5;

a housing having a mounting part to which the conveying roller unit is mounted;

a first shaft part having a first tip end part exposed to the mounting part, the first shaft part supported by the housing in a rotatable manner; and a second shaft part having a second tip end part exposed to the mounting part, the second shaft part supported by the housing on the same axis as the first shaft part on the opposite side to the first shaft part with respect to the mounting part, wherein the first connection section is connected to one of the first tip end part and the second tip end part, while the second connection section is connected to the other of the first tip end part and the second tip end part so that a rotation drive force is transmitted to the conveying roller unit for conveying a sheet.

7. A sheet feed device comprising:

the conveying roller unit according to claim 2;

a housing having a mounting part to which the conveying roller unit is mounted;

a first shaft part having a first tip end part exposed to the mounting part, the first shaft part supported by the housing in a rotatable manner; and a second shaft part having a second tip end part exposed to the mounting part, the second shaft part supported by the housing on the same axis as the first shaft part on the opposite side to the first shaft part with respect to the mounting part, wherein the first connection section is connected to one of the first tip end part and the second tip end part, while the second connection section is connected to the other of the first tip end part and the second tip end part so that a rotation drive force is transmitted to the conveying roller unit for conveying a sheet.

8. A sheet feed device comprising:

the conveying roller unit according to claim 1;

a housing having a mounting part to which the conveying roller unit is mounted;

a first shaft part having a first tip end part exposed to the mounting part, the first shaft part supported by the housing in a rotatable manner; and a second shaft part having a second tip end part exposed to the mounting part, the second shaft part supported by the housing on the same axis as the first shaft part on the opposite side to the first shaft part with respect to the mounting part, wherein the first connection section is connected to one of the first tip end part and the second tip end part, while the second connection section is connected to the other of the first tip end part and the second tip end part so that a rotation drive force is transmitted to the conveying roller unit for conveying a sheet.

9. The sheet feed device according to claim 8, wherein the conveying roller unit is capable of being inserted between the first tip end part and the second tip end part in the mounting part, in a compressed state in which the rod section positioned at the third position is moved to a fourth position located on a downstream side of the second position in the insertion direction against the urging force of the urging member, and after the conveying roller unit is inserted between the first tip end part and the second tip end part, the first connection section and the second connection section are respectively connected to the first tip end part and the second tip end part, in an expanded state in which the rod section is moved from the fourth position to the third position by the urging force of the urging member.

10. The sheet feed device according to claim 9, wherein the second unit includes a restricting projection provided to protrude on the rear end side of the second engagement section, and when the rod section is positioned at the fourth position, the restricting projection abuts the first engagement section so that movement of the rod section to the front end side is restricted.

11. An image forming apparatus comprising:

an image forming unit configured to form an image on a sheet; and the sheet feed device according to claim 10, configured to feed the sheet to the image forming unit.

12. An image forming apparatus comprising:

an image forming unit configured to form an image on a sheet; and the sheet feed device according to claim 9, configured to feed the sheet to the image forming unit.

13. An image forming apparatus comprising:

an image forming unit configured to form an image on a sheet; and the sheet feed device according to claim 8, configured to feed the sheet to the image forming unit.

* * * * *